US009670884B2

(12) United States Patent
Park et al.

(10) Patent No.: US 9,670,884 B2
(45) Date of Patent: Jun. 6, 2017

(54) COOLANT CONTROL VALVE THAT SELECTIVELY SUPPLIES EGR COOLER WITH COOLANT

(71) Applicants: Hyundai Motor Company, Seoul (KR); Kia Motors Corporation, Seoul (KR)

(72) Inventors: Yoonghwa Park, Seongnam-si (KR); Jongho Lee, Yongin-si (KR); Jeonjin Park, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 194 days.

(21) Appl. No.: 14/539,615

(22) Filed: Nov. 12, 2014

(65) Prior Publication Data

US 2015/0354507 A1 Dec. 10, 2015

(30) Foreign Application Priority Data

Jun. 5, 2014 (KR) ..... 10-2014-0068535

(51) Int. Cl.
*F02M 25/07* (2006.01)
*F02M 26/65* (2016.01)
(Continued)

(52) U.S. Cl.
CPC .... *F02M 25/0735* (2013.01); *F02M 25/0737* (2013.01); *F02M 26/30* (2016.02); *F02M 26/32* (2016.02); *F02M 26/65* (2016.02)

(58) Field of Classification Search
CPC ..... F02M 26/30; F02M 26/31; F02M 26/32; F02M 26/33; F02M 26/52; F02M 26/53;
(Continued)

(56) References Cited

U.S. PATENT DOCUMENTS 4,280,416 A * 7/1981 Edgerton ..... B01D 53/005 110/254
4,286,624 A * 9/1981 Clausen ..... F16K 11/207 137/255

(Continued)

FOREIGN PATENT DOCUMENTS

JP 2004-197634 A 7/2004
JP 2014-1646 A 1/2014
JP 2014-9617 A 1/2014

*Primary Examiner* — Carlos A Rivera
*Assistant Examiner* — Carl Staubach
(74) *Attorney, Agent, or Firm* — Morgan Lewis & Bockius LLP

(57) ABSTRACT

A coolant control valve that selectively supplies an EGR cooler with coolant may include a cylinder head having a first water jacket and a second water jacket, an EGR cooler that is disposed at one side of the cylinder head and is disposed on an EGR line that recirculates exhaust gas from an exhaust side to an intake side, a heater that is disposed at another side of the cylinder head and heats air through coolant that is supplied to the heater, and a coolant control valve that respectively controls coolant that is supplied from the first water jacket and the second water jacket, supplies the heater with the coolant, and selectively supplies the EGR cooler with the coolant depending on a temperature of the coolant.

4 Claims, 7 Drawing Sheets

(51) Int. Cl.
*F02M 26/30* (2016.01)
*F02M 26/32* (2016.01)

(58) Field of Classification Search
CPC ..... F02M 26/54; F02M 26/65; F02M 26/70; F02M 26/71; F02M 26/72; F02M 2026/004; F02M 26/12; F02M 26/13; F02D 41/0047–41/0055; F02D 21/08; F02D 2021/083; F02D 2021/086; F02D 41/0077; F02D 41/0065
USPC ..... 701/108; 60/39.52, 288, 605.2
See application file for complete search history.

(56) References Cited

U.S. PATENT DOCUMENTS 4,860,785 A * 8/1989 Sundstrom, Jr. ... F02M 37/0023 137/255
5,562,442 A * 10/1996 Wilhelm ..... F23G 7/068 110/211
5,692,892 A * 12/1997 Houston ..... F23G 7/068 432/180
6,378,509 B1 * 4/2002 Feucht ..... F02M 26/43 123/568.12
2009/0114171 A1 * 5/2009 Hayashi ..... F01P 3/02 123/41.44
2010/0154759 A1 * 6/2010 Taira ..... F02M 13/00 123/568.17
2011/0061625 A1 * 3/2011 Joergl ..... F02M 26/16 123/190.1
2011/0123315 A1 * 5/2011 Robinson ..... F02B 37/004 415/145
2012/0048217 A1 * 3/2012 Triebe ..... F01P 7/14 123/41.1
2012/0067545 A1 * 3/2012 Yamazaki ..... F01M 5/00 165/52
2012/0312256 A1 * 12/2012 Komurian ..... F01P 7/167 123/41.44
2013/0019848 A1 * 1/2013 Noguchi ..... F02M 26/39 123/568.12
2014/0202403 A1 * 7/2014 Maki ..... F01P 11/08 123/41.33
2014/0283765 A1 * 9/2014 Naito ..... F01P 3/12 123/41.09
2015/0354436 A1 * 12/2015 Park ..... F01P 7/14 123/41.08
2016/0123217 A1 * 5/2016 Park ..... F01P 7/14 137/468

* cited by examiner

COOLANT CONTROL VALVE THAT SELECTIVELY SUPPLIES EGR COOLER WITH COOLANT

CROSS-REFERENCE TO RELATED APPLICATION

The present application claims priority to Korean Patent Application No. 10-2014-0068535 filed Jun. 5, 2014, the entire contents of which is incorporated herein for all purposes by this reference.

BACKGROUND OF THE INVENTION

Field of the Invention

The present invention is related to a coolant control valve that selectively supplies an EGR cooler with coolant, which selectively circulates an EGR cooler with coolant depending on a driving condition of an engine instead of an EGR valve.

Description of Related Art

Generally, in a vehicle, fuel is burned in a cylinder to be expended, and then exhaust gas is exhausted to an outside through an exhaust manifold.

Most of the exhaust gas is vapor and CO2, and includes carbon monoxide (CO), hydrocarbon (HC), and nitrogen oxide (NOx).

An exhaust gas recirculation system reduces nitrogen oxide of the exhaust gas by recirculating exhaust gas to an intake manifold such that combustion temperature is lowered and the nitrogen oxide is reduced, when air fuel mixture is combusted.

Then, the combustion speed is reduced, if the increment of the combustion temperature is suppressed, resultantly, the nitrogen oxide can be reduced.

Meanwhile, an exhaust gas recirculation valve is disposed between an exhaust manifold and an intake manifold and opens or closes a circulation line by controlling an EGR valve in a specific rotation area.

An EGR valve is opened depending on an opening rate of a throttle valve to recirculate exhaust gas to an intake manifold of an engine such that the output decrement of the engine is minimized and combustion temperature is decreased to amount of the nitrogen oxide (Nox).

The exhaust gas recirculation device includes an EGR pipe, an EGR valve that is disposed on the EGR pipe to open or close the EGR pipe, and an EGR cooler that is disposed on the EGR pipe to cool the recirculation gas passing the EGR pipe.

An inlet is formed at one side of the EGR cooler to receive the coolant of an engine, and an outlet is formed at the other side thereof to exhaust the coolant that cools the recirculation.

Meanwhile, an EGR coolant valve is disposed to control the coolant passing the EGR cooler, the cost is increased due to the EGR coolant valve, and a separate actuator is necessary to control the EGR coolant valve.

FIG. 7 is a schematic diagram showing an EGR cooler that is related to the present invention. Referring to FIG. 7, the figure includes an EGR line 710, an EGR cooler 560, a bypass line 700, a bypass valve 730, and an EGR valve 720.

EGR gas that is recirculated from an exhaust line to an intake line passes an EGR line 710 and an EGR cooler 560 to join the intake line, the EGR gas flow the bypass line 700 bypassing the EGR cooler 560, and a bypass valve 730 is necessary and a separate actuator is also necessary.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a coolant control valve that selectively supplies an EGR cooler with coolant having advantages of improving structure of a coolant control valve and decreasing the number of components and production cost.

According to various aspects of the present invention, a coolant control valve that selectively supplies an EGR cooler with coolant may include a cylinder head having a first water jacket and a second water jacket, an EGR cooler that is disposed at one side of the cylinder head and is disposed on an EGR line that recirculates exhaust gas from an exhaust side to an intake side, a heater that is disposed at another side of the cylinder head and heats air through coolant that is supplied to the heater, and a coolant control valve that respectively controls coolant that is supplied from the first water jacket and the second water jacket, supplies the heater with the coolant, and selectively supplies the EGR cooler with the coolant depending on a temperature of the coolant.

The coolant control valve may include a valve body having a mounting space formed therein, a sealing ring that has a cylindrical shape and is rotatably disposed in the mounting space based on a length direction where a blocking wall is formed in a coolant inlet of a front end portion of the sealing ring, a motor that rotates the sealing ring depending on the coolant temperature, and a plate that is disposed on the valve body, a first passage that is connected to the first water jacket to be opened or closed by the blocking wall depending on a rotation position of the sealing ring is formed, and a second passage that is formed near the first passage and is connected to the second water jacket to continuously supply the heater with coolant.

The blocking wall may have a semi-circular shape, and the first passage has a semi-circular shape corresponding to the shape of the blocking wall.

A coolant outlet may be formed on the sealing ring and the coolant outlet may be formed from an inner side to an outer side of the sealing ring to supply the coolant that is supplied to the inner side to a radiator and is formed in a rotating direction of the sealing ring.

The first passage may be connected to the first water jacket, the second passage may be connected to the second water jacket, and the valve body may be mounted on an outside of the cylinder head through a plate to be fixed thereto.

The second water jacket may be formed under the first water jacket, and the first passage may be correspondingly formed under the second passage.

In accordance with the present invention for realizing the objects, an EGR valve and an actuator for controlling this are eliminated to be able to decrease the number of components and production cost.

Further, a coolant control valve is improved to a relatively simple structure such that cost is saved and the controlling thereof becomes easy.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
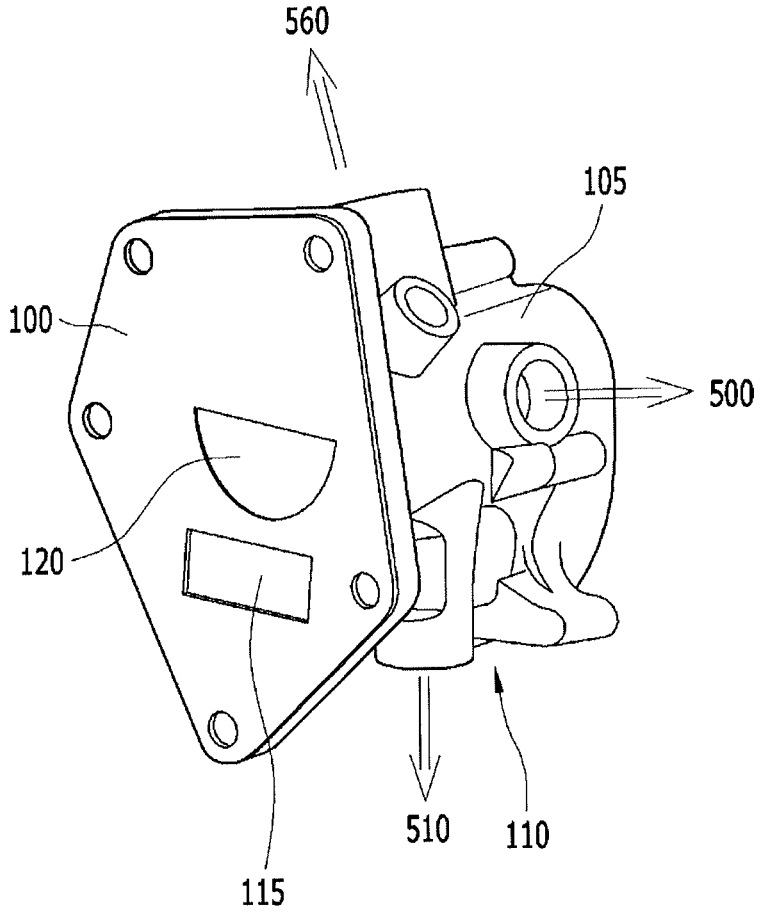
FIG. 1 is a perspective view of an exemplary coolant control valve that selectively supplies an EGR cooler with coolant according to the present invention.

FIG. 1 is a perspective view of a coolant control valve that selectively supplies an EGR cooler with coolant according to various embodiments of the present invention.

Referring to FIG. 1, a coolant control valve 110 includes a valve body 105 and a plate 100, and a first passage 120 and a second passage 115 are formed on the plate 100 by a predetermined distance.

The coolant that is supplied through the first passage 120 is selectively supplied to an EGR cooler 560 and a radiator 500. And, the coolant that is supplied through the second passage is always supplied to the heater 510.

Figure 2:
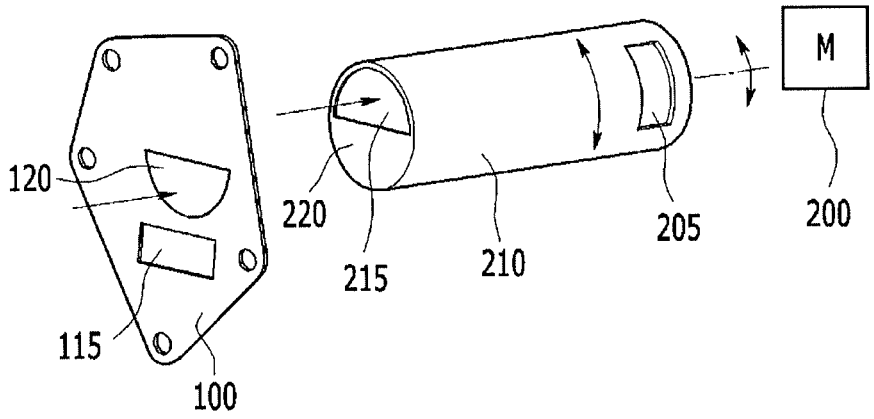
FIG. 2 is a partial exploded perspective view of the exemplary coolant control valve according to the present invention.

FIG. 2 is a partial exploded perspective view of a coolant control valve according to various embodiments of the present invention.

Referring to FIG. 2, a sealing ring 210 is inserted into a mounting space that is formed in the valve housing 105. The sealing ring 210 has a structure that is rotated by a motor 200, and a control portion operates the motor 200 depending on the coolant temperature to rotate the sealing ring 210.

The sealing ring 210 has a pipe shape and the exterior circumference thereof slides on the interior circumference of the mounting space of the valve body 105 to form a sealing structure between them.

A coolant inlet 215 is formed at a front side of the sealing ring 210, and a blocking wall 220 is formed on a partial area of the coolant inlet. And, a coolant outlet 205 is formed from the interior toward the exterior of the sealing ring 210.

As shown, the coolant inlet 215 is a semi-circular shape and the blocking wall 220 is a semi-circular shape that is formed at one side of the coolant inlet 215. Accordingly, the coolant inlet 215 and the blocking wall 220 have a semi-circular shape to form one circular shape.

A first passage 120 is formed on the plate 100 corresponding to the coolant inlet 215 of the sealing ring 210, and the first passage 120 has a semi-circular shape corresponding to the blocking wall 220 or the coolant inlet 215.

In various embodiments of the present invention, if the motor 200 rotates the sealing ring 210, the blocking wall 220 that is formed in the coolant outlet 205 of a front end portion of the sealing ring 210 selectively closes the first passage 120, and the coolant that is supplied to the EGR cooler 560 is controlled.

And, the coolant that is supplied to the second passage 115 does not pass the sealing ring 210 and is always supplied to the heater 510 through a separate passage that is formed in the valve body 105.

Figure 3:
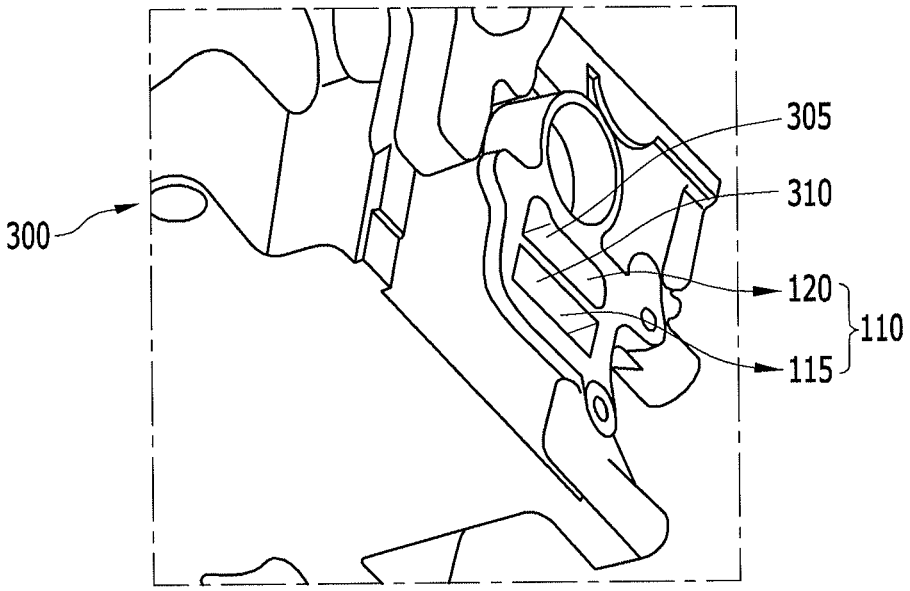
FIG. 3 is a partial perspective view of a cylinder head that the exemplary coolant control valve is disposed in according to the present invention.

FIG. 3 is a partial perspective view of a cylinder head that a coolant control valve is disposed in according to various embodiments of the present invention.

Referring to FIG. 3, a first water jacket 305 and a second water jacket 310 are formed in the cylinder head 300, the coolant passing the first water jacket 305 is supplied to the first passage 120, and the coolant passing the second water jacket 310 is supplied to the second passage 115.

More specifically, the plate 100 is direct engaged with the cylinder head 300 together with the valve body 105 and receives coolant from the first water jacket 305 and second water jacket 310 through the first passage 120 and the second passage 115, and the first water jacket 305 and second water jacket 310 are formed by a distance in an upper and lower direction.

Figure 4A:
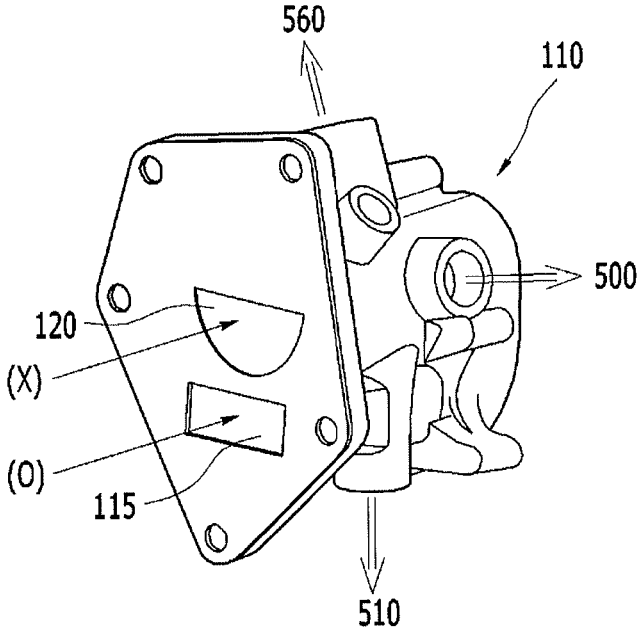
FIG. 4A and FIG. 4B show an operational state of the exemplary coolant control valve according to the present invention.
Figure 4B:
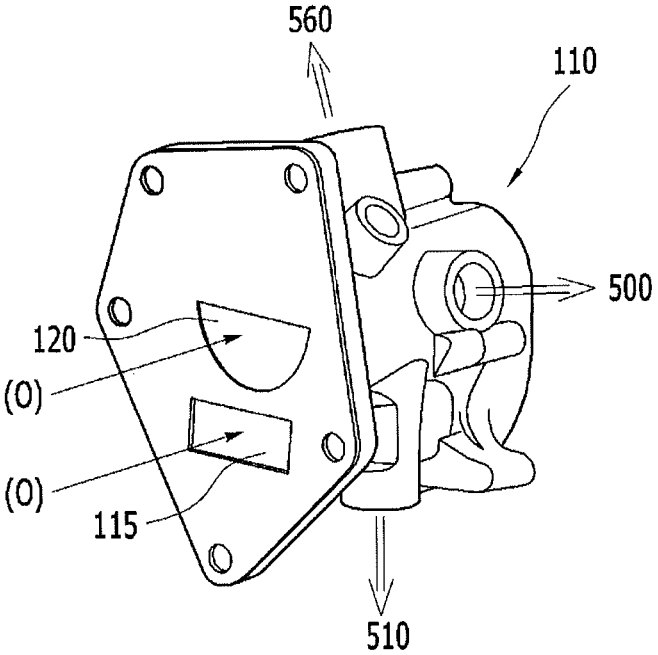

FIG. 4A and FIG. 4B show an operational state of a coolant control valve according to various embodiments of the present invention.

Referring to FIG. 4A, in case that the coolant temperature is lower than a predetermined value, the blocking wall 220 of the sealing ring 210 closes the first passage 120, the coolant is not supplied to the EGR cooler 560, and the coolant is supplied to the heater 510 through the second passage 115.

Referring to FIG. 4B, in case that the coolant temperature is higher than a predetermined value, the first passage 120 is opened by the coolant inlet 215 of the sealing ring 210, the coolant is supplied to the EGR cooler 560, and the coolant is supplied to the heater 510 through the second passage 115.

The coolant is selectively supplied to the radiator 500 through the coolant outlet 205 of the sealing ring 210 in FIG. 4A and FIG. 4B. Particularly, the coolant that is supplied to the sealing ring 210 is supplied to the radiator 500 through the coolant outlet 205 of the sealing ring 210 depending on the coolant temperature.

Figure 5:
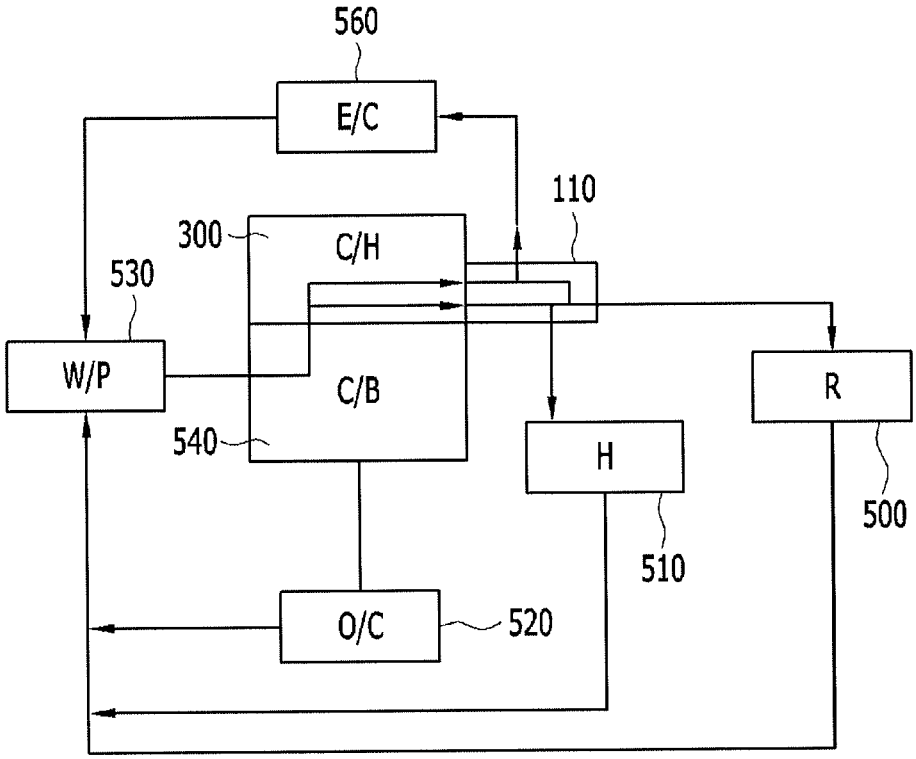
FIG. 5 is a schematic diagram of a coolant system that the exemplary coolant control valve is applied to according to the present invention.

FIG. 5 is a schematic diagram of a coolant system that a coolant control valve is applied to according to the present invention.

Referring to FIG. 5, a coolant system includes a cylinder block 540, a cylinder head 300, a coolant control valve 110, an EGR cooler 560, a coolant pump 530, an oil cooler 520, a heater 510, and a radiator 500.

The coolant that is pumped by the coolant pump 530 passes the cylinder block 540 and the cylinder head 300 to be supplied to the coolant control valve 110, and the coolant control valve 110 controls the coolant that is respectively supplied to the EGR cooler 560, the heater 510, and the radiator 500.

Further, the coolant that is pumped by the coolant pump 530 passes the oil cooler 520 through the cylinder block 540.

Figure 6A:
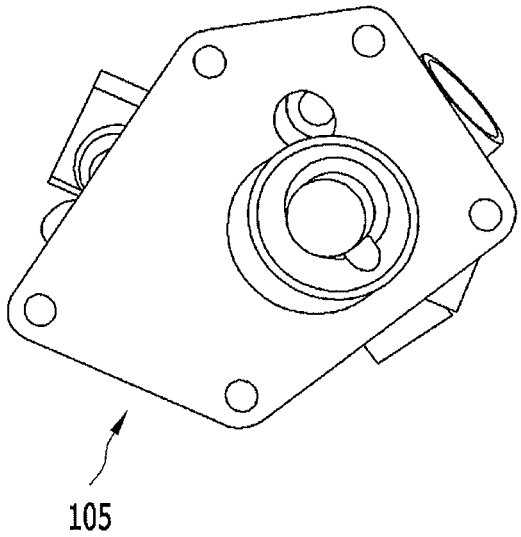
FIG. 6A (Related Art)
FIG. 6A and FIG. 6B are partial exploded perspective views of a coolant control valve according to the related art.
Figure 6B:
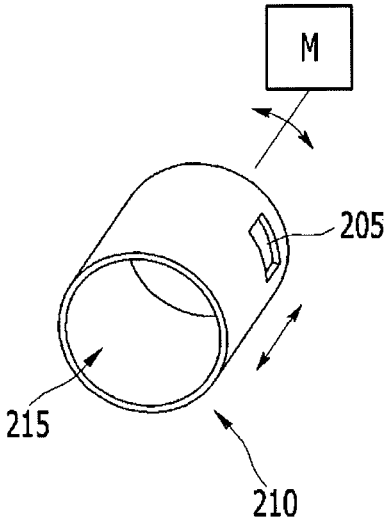
FIG. 6B (Related Art)
Figure 7:
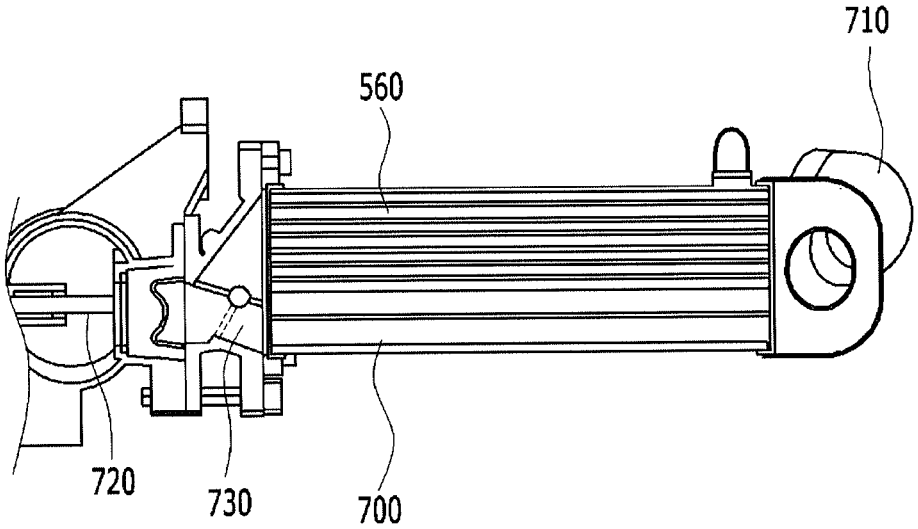
FIG. 7 is a schematic diagram showing an EGR cooler according to the present invention.

FIG. 6A and FIG. 6B are partial exploded perspective views of a coolant control valve showing a related art of the present invention.

Referring to FIG. 6A and FIG. 6B, a blocking wall 220 is not formed on the sealing ring 210, a circularly opened coolant inlet 215 is formed therein, and when the motor 200 opens the sealing ring 210, the coolant is always supplied to the sealing ring 210.

Accordingly, as described above, because the blocking wall 220 is not formed on the coolant inlet of the sealing ring 210, a controlling efficiency is deteriorated and the coolant cannot be variably controlled.

However, in various embodiments of the present invention, the blocking wall 220 is formed in the coolant inlet 215 of the sealing ring 210 and a first passage 120 is formed on the plate 100 such that the coolant is efficiently controlled, and a separate second passage 115 is formed on the plate 100 and the coolant that passes the second passage 115 does not pass the sealing ring 210 to be direct supplied to the heater 510 through the valve body 105.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A coolant control valve that selectively supplies an EGR cooler with coolant, comprising:

a cylinder head including a first water jacket and a second water jacket;

an EGR cooler that is disposed at one side of the cylinder head and is disposed on an EGR line that recirculates exhaust gas from an exhaust side to an intake side;

a heater that is disposed at another side of the cylinder head and heats air through coolant that is supplied to the heater; and a coolant control valve that respectively controls coolant that is supplied from the first water jacket and the second water jacket, supplies the heater with the coolant, and selectively supplies the EGR cooler with the coolant depending on a temperature of the coolant, wherein the coolant control valve includes:

a valve body having a mounting space formed therein;

a sealing ring that has a cylindrical shape and is rotatably disposed in the mounting space based on a length direction, wherein a blocking wall is formed in a coolant inlet of a front end portion of the sealing ring;

a motor that rotates the sealing ring depending on the coolant temperature; and a plate that is disposed on the valve body, wherein a first passage connected to the first water jacket to be opened or closed by the blocking wall depending on a rotation position of the sealing ring is formed on the plate, and wherein a second passage is formed through the plate of the coolant control valve near the first passage and is connected to the second water jacket to continuously supply the heater with coolant.

2. The coolant control valve that selectively supplies the EGR cooler with coolant of claim 1, wherein the blocking wall has a semi-circular shape, and the first passage has a semi-circular shape corresponding to the shape of the blocking wall.

3. The coolant control valve that selectively supplies the EGR cooler with coolant of claim 1, wherein a coolant outlet is formed on the sealing ring and the coolant outlet is formed from an inner side to an outer side of the sealing ring to supply the coolant that is supplied to the inner side to a radiator and is formed in a rotating direction of the sealing ring, and wherein the first passage is connected to the first water jacket, the second passage is connected to the second water jacket, and the valve body is mounted on an outside of the cylinder head through the plate to be fixed thereto.

4. The coolant control valve that selectively supplies the EGR cooler with coolant of claim 1, wherein the second water jacket is formed under the first water jacket, and the first passage is correspondingly formed under the second passage.

* * * * *